US005229063A

United States Patent [19]

Stomp et al.

[11] Patent Number: 5,229,063

[45] Date of Patent: Jul. 20, 1993

[54] PROCESS FOR THE TREATMENT OF STEEL-MILL SLAG AND APPARATUS FOR CARRYING IT OUT

[75] Inventors: Hubert Stomp, Howald; Marc Solvi, Ehlange; Albert Feitler, Strassen, all of Luxembourg

[73] Assignee: Paul Wurth S.A., Luxembourg

[21] Appl. No.: 843,528

[22] Filed: Feb. 28, 1992

[30] Foreign Application Priority Data

Mar. 1, 1991 [LU] Luxembourg ..... 87896

[51] Int. Cl.[5] ..... C22B 7/04

[52] U.S. Cl. ..... 266/45; 65/19; 65/141; 75/387; 266/83

[58] Field of Search ..... 65/19, 20, 141; 266/45, 266/83; 75/387

[56] References Cited

U.S. PATENT DOCUMENTS 3,469,961 9/1969 Barnhart et al. ..... 65/19
3,765,860 10/1973 Forschepiepe ..... 65/141
4,494,971 1/1985 Monteyne et al. ..... 65/19

*Primary Examiner*—Melvyn J. Andrews
*Attorney, Agent, or Firm*—Fishman, Dionne & Cantor

[57] ABSTRACT

The present invention provides a new process and a new apparatus for the treatment of steel-mill slag in a vessel which allows a wet granulation of the slag without the risk of explosions. The slag is caused to flow through a taphole at the bottom of the vessel, and the flow rate of the slag is determined by means of a continuous check of the weight of the vessel. One or more jets of granulating water, the flow rate of which is adjusted as a function of the slag flow rate, are directed onto the stream of slag flowing from the vessel. The apparatus comprises a vessel containing molten slag. This vessel is equipped with weighing means, with a taphole, with a device for shutting off the taphole, with means for maneuvering the shut-off device between an operating position and a stored or parked position away from the taphole and with a device for opening or freeing the taphole, engageable through the latter in order to initiate the flow of slag.

14 Claims, 7 Drawing Sheets

PROCESS FOR THE TREATMENT OF STEEL-MILL SLAG AND APPARATUS FOR CARRYING IT OUT

BACKGROUND OF THE INVENTION

The present invention relates to a process for treating steel-mill slag contained in a vessel in the liquid state, and to an apparatus for treating this slag.

In contrast to blast-furnace slag, which is used in the building sector after granulation and cooling, steel-mill slag obtained as a by-product when producing steel in a ladle or converter is employed as fertilizer because of its high content of phosphates as a result of the dephosphorisation of the steel. Whereas blast-furnace slag can be treated continuously as it is produced, steel-mill slag is produced intermittently in large quantities and, with the means available at the present time, cannot be cooled and granulated in the same way as blast-furnace slag.

Steel-mill slag, which floats on the surface of the bath of molten steel in a ladle or in a converter, is emptied into a vessel at the end of the steel treatment operation. It is subsequently conveyed, together with the vessel, to a dump or a storage site where the slag is cooled in block form. After being cooled in the open air, it is crushed to a fine powder which can be used as fertilizer. The powder is generally known as Thomas slag. To make it easier to use this slag, the powder can also be converted into granules.

This treatment of the cooled slag, particularly the crushing, generates an enormous amount of dust which is very difficult to control. In an effort to improve upon this process and because of the increasingly stringent environmental protection regulations, cooling and granulating the slag in water, as is done in the treatment of blast-furnace slag, has been tested. Unfortunately, these tests were unsuccessful because steel-mill slag is produced intermittently and is required to be stored in a vessel or ladle before its treatment. These tests therefore involved pouring the molten slag from the vessel by pouring the slag over the upper edge of the vessel and onto a granulation device in which the stream of molton slag undergoes the action of granulating water. These tests revealed several problems associated with pouring slag in this manner which prevented the process from being put into practice. It was impossible to prevent violent explosions attributable to the instantaneous evaporation of the water and the rapid changes of slag volume. This was exacerbated by the irregular pouring of the slag which, furthermore, can contain blocks of slag or even of steel in the pasty or solid state.

SUMMARY OF THE INVENTION

The object of the present invention is to provide a new process and apparatus for the treatment of steel-mill slag which allows a wet granulation of the slag without risks of explosions.

To achieve this objective, the process provided by the invention involves causing the slag to flow through a taphole at the bottom of the vessel, determining the flow rate of the slag by means of a continuous check of the weight of the vessel, and directing one or more jets of granulating water, the flow rate of which is adjustable as a function of the slag flow rate, onto the stream of slag flowing from the vessel.

In comparison with the tests described above, the process of the present invention allows a better control of the flow. First, the flow rate is defined much more precisely by the cross-section of the taphole, as compared with the random flow rate when pouring over the upper edge of the ladle. Second, the continuous weighing of the ladle makes it possible to monitor the slag flow rate by observing the decrease in slag weight, which consequently makes it possible to adjust and regulate the quantity of granulating water as a function of the slag flow rate. This control of the flow can be further improved by installing viewing cameras.

The invention also provides apparatus for carrying out this process, which is comprised of: a taphole in the bottom of the wall of the vessel; means for weighing the vessel; a device for shutting off the taphole; means for maneuvering said shut-off device between a closing position and an opening position away from the tap hole orifice; and by a device for opening or freeing the taphole, engageable through the latter in order to initiate the flow of slag.

The device for shutting off and opening the taphole is carried by an arm mounted pivotably on the wall of the vessel and subjected to the action of a spring ensuring the positioning of the arm both in the stored or parked position and in the working position. The shut-off device consists of a plug and the device for freeing the taphole consists of a rod, the two being arranged in a "V" on a shaft pivoting in a support fastened to said pivoting arm. Maneuvering means make it possible to pivot this arm in such a way as to place either the plug or the rod in the operative angular position in the axis of the taphole when said arm is in the working position.

The operative angular positions of the plug and of the rod, are preferably defined by two stop abutments and by a spring compressed between the support and a lever fixed to said shaft, in such a way that the plug and the rod are maintained in their operative positions under the action of the spring and bearing on their respective abutments.

The positions of the abutments are preferably adjustable for the purpose of adjusting the operative angular positions of the plug and of the rod.

The maneuvering means are preferably mounted on a movable carriage sliding along a framework next to the vessel and comprise a first maneuvering arm pivoting under the action of a first jack and equipped with a hydraulic gripper, in order to be coupled to the arm pivoting on the vessel, and a second maneuvering arm pivoting under the action of a second jack, in order to actuate the shut-off plug and the opening rod of the taphole.

The shaft of the plug and of the rod can be fixed to a crank offset relative to the shaft and engageable in a fork at the end of the second maneuvering arm.

The means for weighing the vessel can consist of one or more weight sensors, on which the vessel is placed before the taphole is opened.

It should be noted that the process provided does not require a special vessel and can be carried out with the vessels used at the present time. It is sufficient to make an orifice in the bottom of the wall of the vessel and to fasten to this, above the taphole, the device for shutting off and opening the taphole.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 4:
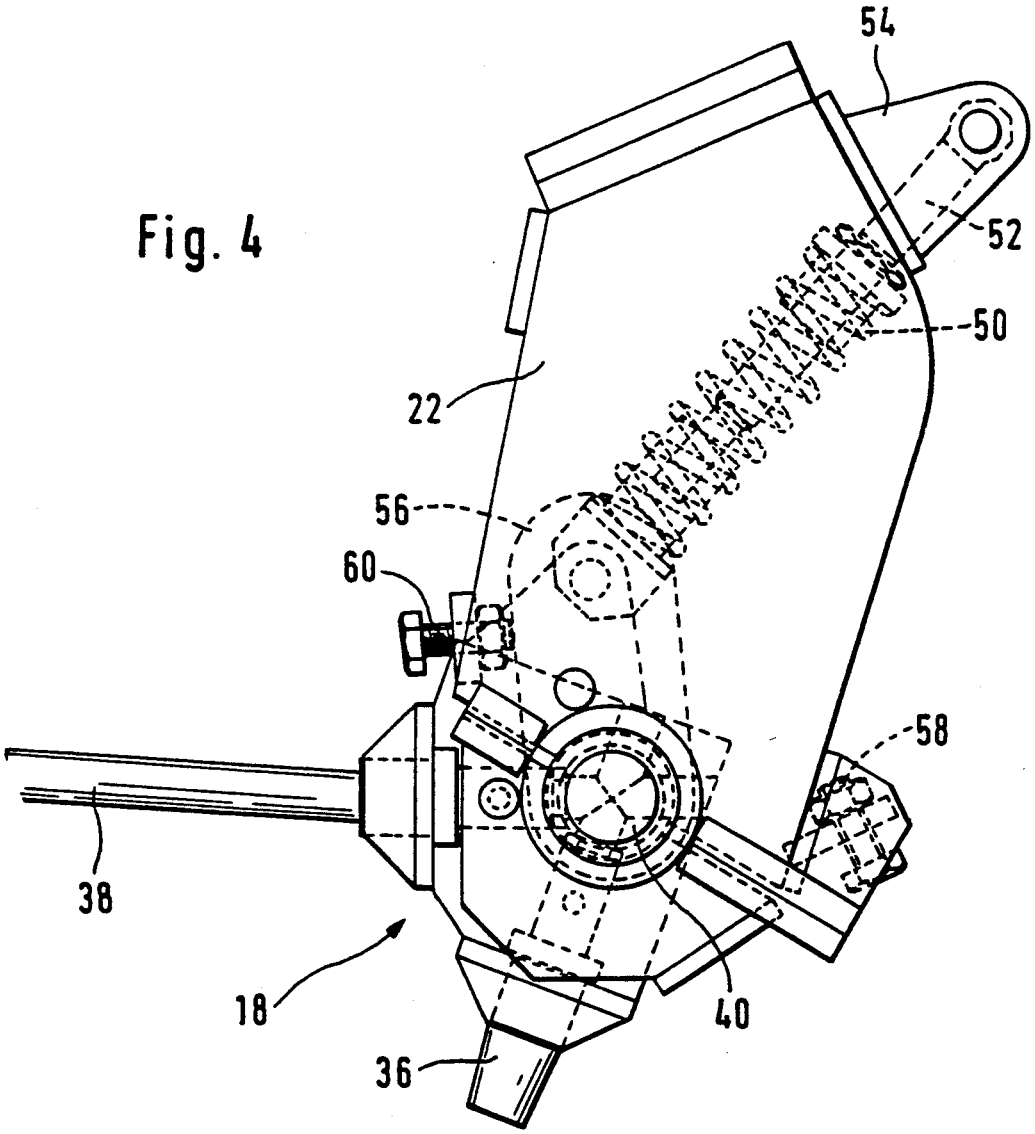
FIG. 4 is a view similar to that of FIG. 3, showing the opening or freeing rod in the operative position.
Figure 5:
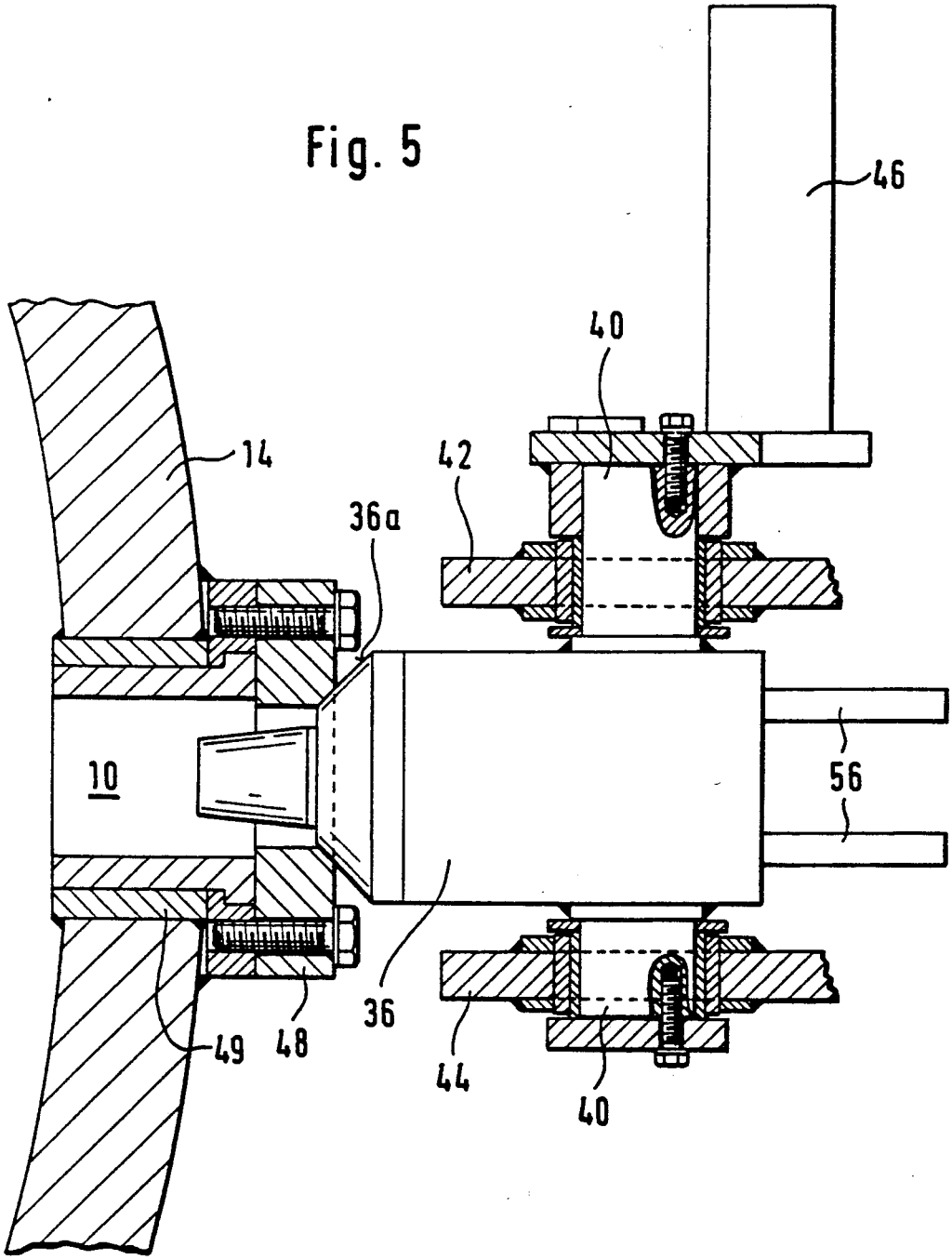
FIG. 5 shows an axial section with the details of the taphole and of the shut-off plug.
Figure 6:
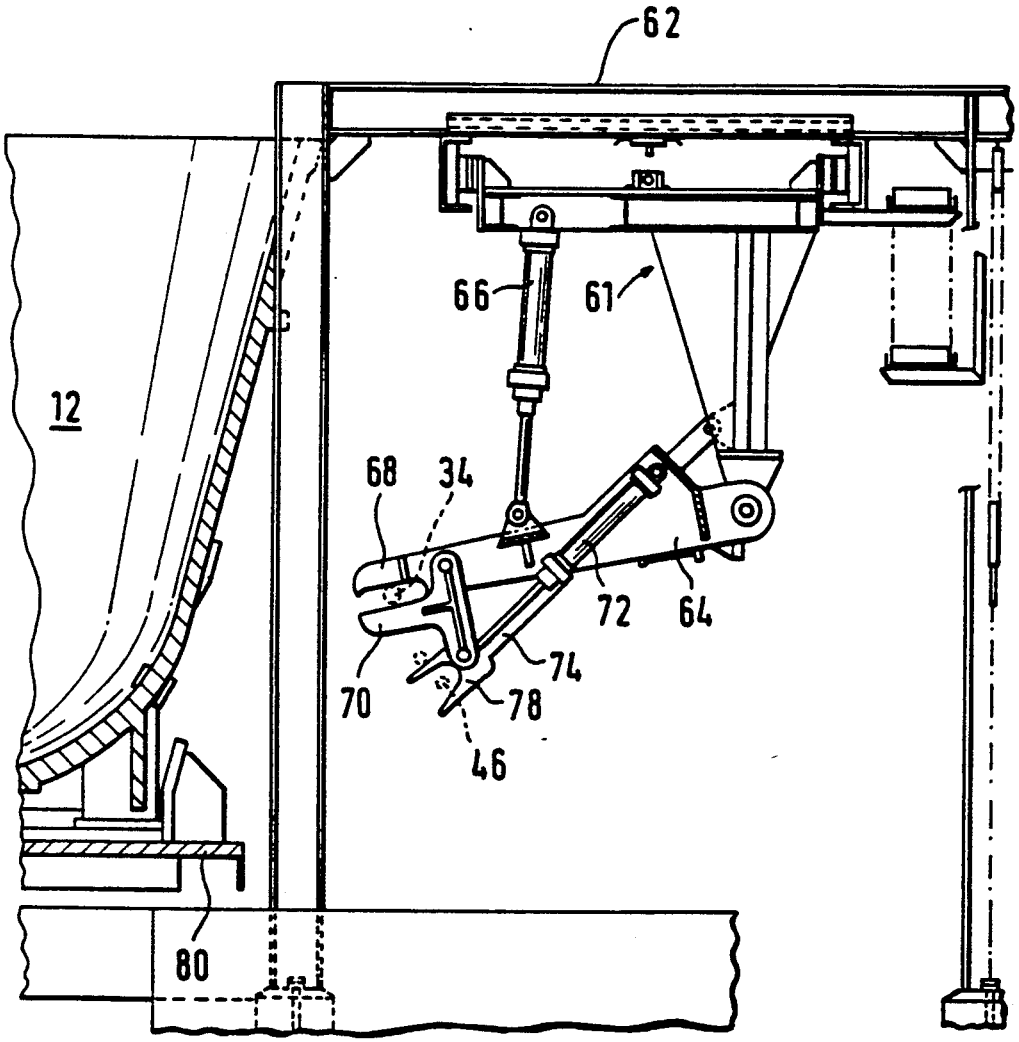
FIGS. 6 and 7 show diagrammatically the maneuvering means in two different positions.
Figure 7:
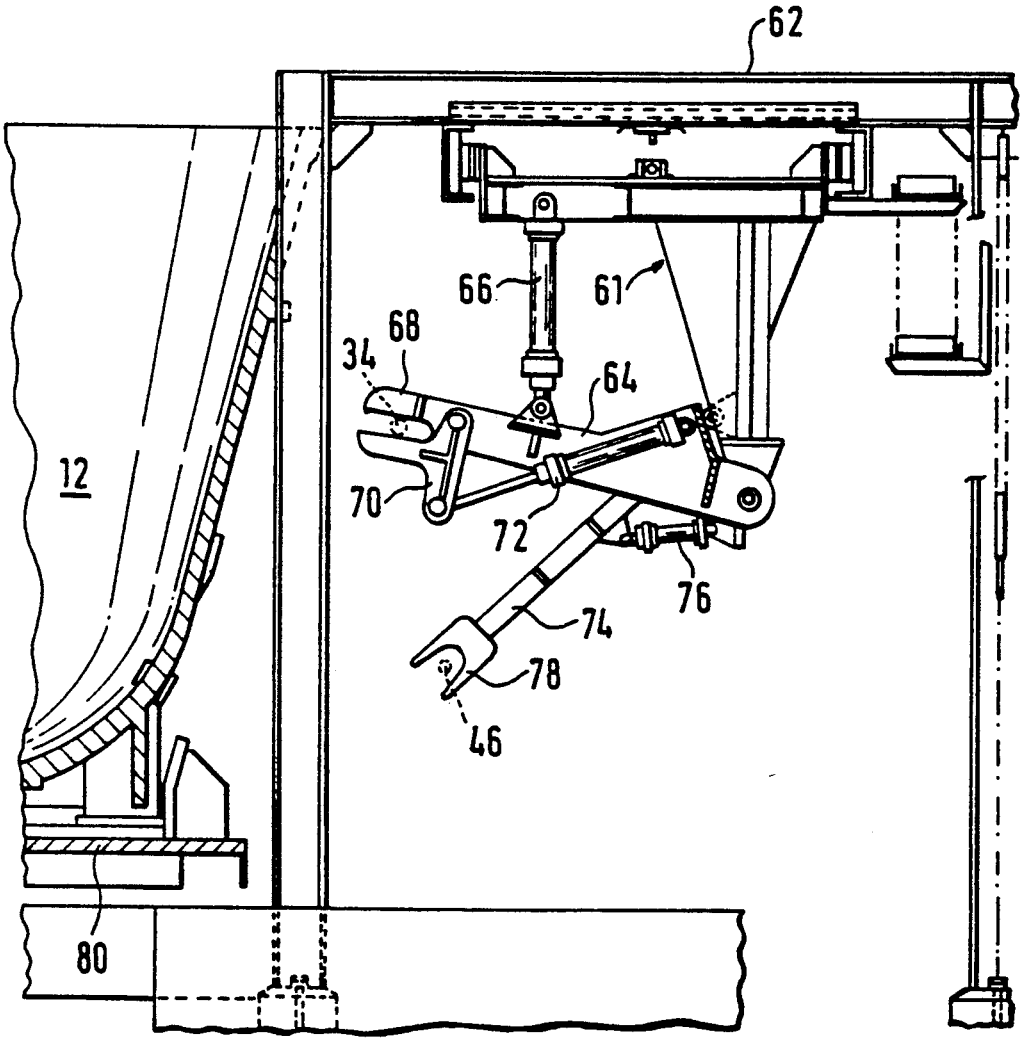

The apparatus provided for carrying out the process according to the invention consists essentially of a control device as shown in FIGS. 1 to 5 and of a mechanism for maneuvering the control device as shown in FIGS. 6 and 7.

For carrying out the process of the present invention for the purpose of the wet granulation of steel-mill slag, a taphole 10 is made in the wall 14 of a vessel 12 intended for receiving the slag from a converter or a casting ladle. To actuate this taphole 10, a control device 16, which will be described in detail with simultaneous reference to FIGS. 1 to 5, is mounted on the outer face of the wall 14 above the taphole 10.

The control device 16 comprises essentially a mechanism 18 for shutting off and freeing the taphole 10, carried by a support 22 fastened to the lower end of an arm 24 which is mounted, by means of its central part, between two brackets 26 welded or bolted to the wall 14 of the vessel 12. A helical spring 28 is compressed between the upper part of the arm 24 and a grounding flange 30 fixed to the wall 14 of the vessel. The location of the connection between the spring 28 and the arm 24 is selected in such a way that, in the position of FIG. 1, the spring 28 acts on the pivoting arm 24 to urge it in the clockwise direction, in order to maintain the device in the position closing the taphole 10.

The pivoting arm 24 includes a central branch 32, at the end of which is located a crossbar 34 capable of undergoing the action of the maneuvering means which will be described hereinafter with reference to FIGS. 6 and 7. These maneuvering means serve to pivot the arm 24 between the working, or closed, position of FIG. 1 and a parked position according to FIG. 2, away from the taphole 10, and vice versa.

Figure 1:
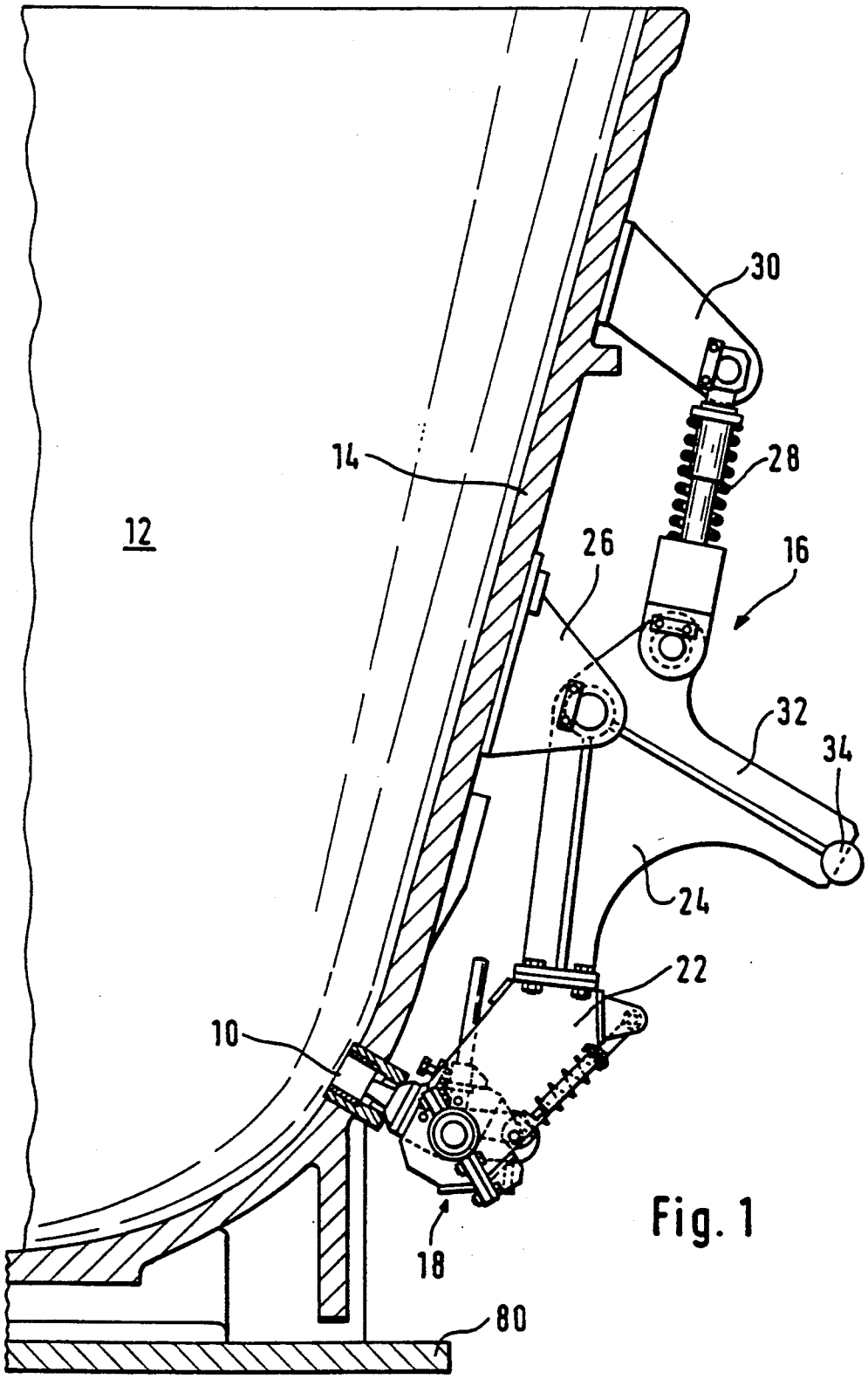
FIG. 1 shows a vertical section through part of a vessel with a flow control device in the closed position.
Figure 2:
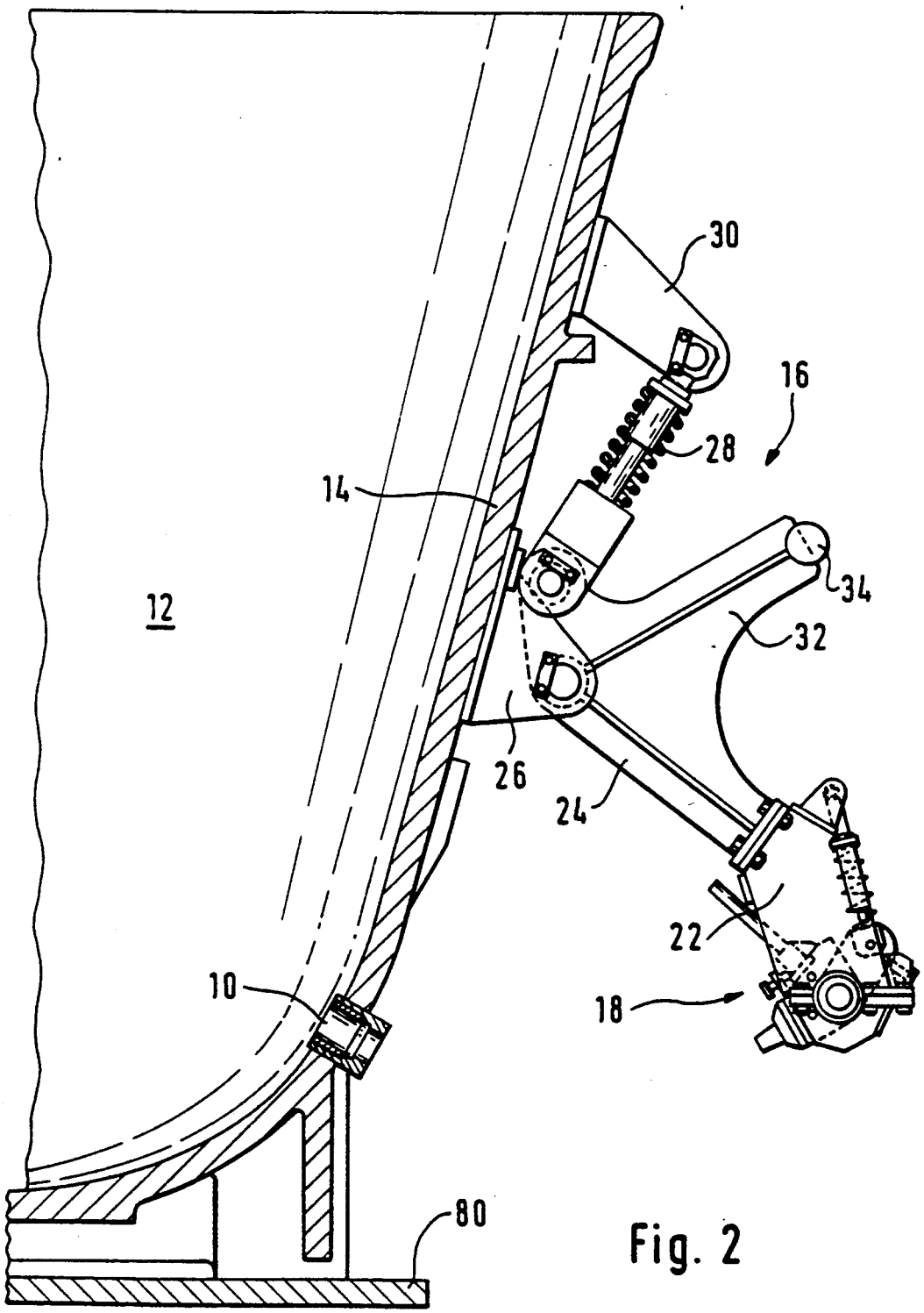
FIG. 2 shows a view similar to that of FIG. 1, with the flow control device in the open position.

As shown in FIGS. 1 and 2, the spring 28 is positioned so as to stabilize the device in both the working position and the parked position. In fact, the pivoting of the arm 24 in order to displace the device from the position of FIG. 1 towards that of FIG. 2 takes place first counter to the action of the spring 28 into an intermediate position which corresponds to dead center and in which the axis of the spring coincides with an imaginary line passing through the pivot axis of the arm 24 and the center of fastening of the spring 28 on the stay 30. From this intermediate position, the final pivoting phase towards the position of FIG. 2 is carried out under the action of the spring 28. Spring 28 is, furthermore, sufficiently strong to maintain the device in the position of FIG. 2. The pivoting of the arm 24 from the position of FIG. 2 towards that of FIG. 1 is likewise executed in two phases, one counter to the action of the spring 28 and, from dead center, under the action of the spring 28.

The device 18 will now be described in more detail with reference to FIGS. 3 to 5. This device consists essentially of a plug 36 for closing the taphole 10 as in FIG. 1 and of a rod 38 intended to be engaged through the taphole 10 in order to initiate the flow of the slag. The plug 36 and the rod 38, which can both be made of refractory steel, are fixed to one another and mutually oriented according to a V-shaped arrangement. The plug 36 and rod 38 are supported by two journals or a shaft 40 seated rotatably in two parallel plates 42, 44 forming the support 22 which is fastened to the pivoting arm 24. One of the ends of the rotary shaft 40 is fixed, beyond one of the plates 42 or 44, to a sleeve 46 offset relative to the axis of the shaft 40 and forming a crank with the latter. By means of this crank 46, the shaft 40 can be actuated by maneuvering means so as to pivot about its axis and position either the plug 36 in the operative position according to FIG. 3 or the rod 38 in the operative position according to FIG. 4, or vice versa. As shown in more detail in FIG. 5, the closing of the taphole 10 is ensured by mutual contact between a frustoconical section 36*a* of the plug 36 and a plate 48 having a complimentary closing surface, the plate 48 being screw fastened to a fitting 49 defining the taphole 10. This makes it possible to replace the plate 48 in the event of wear and avoids the need to repair the fitting 50. Moreover, it is possible to provide different calibers of plates 48 having different passage cross-sections in order, if necessary, to modify the flow rate of the slag.

Figure 3:
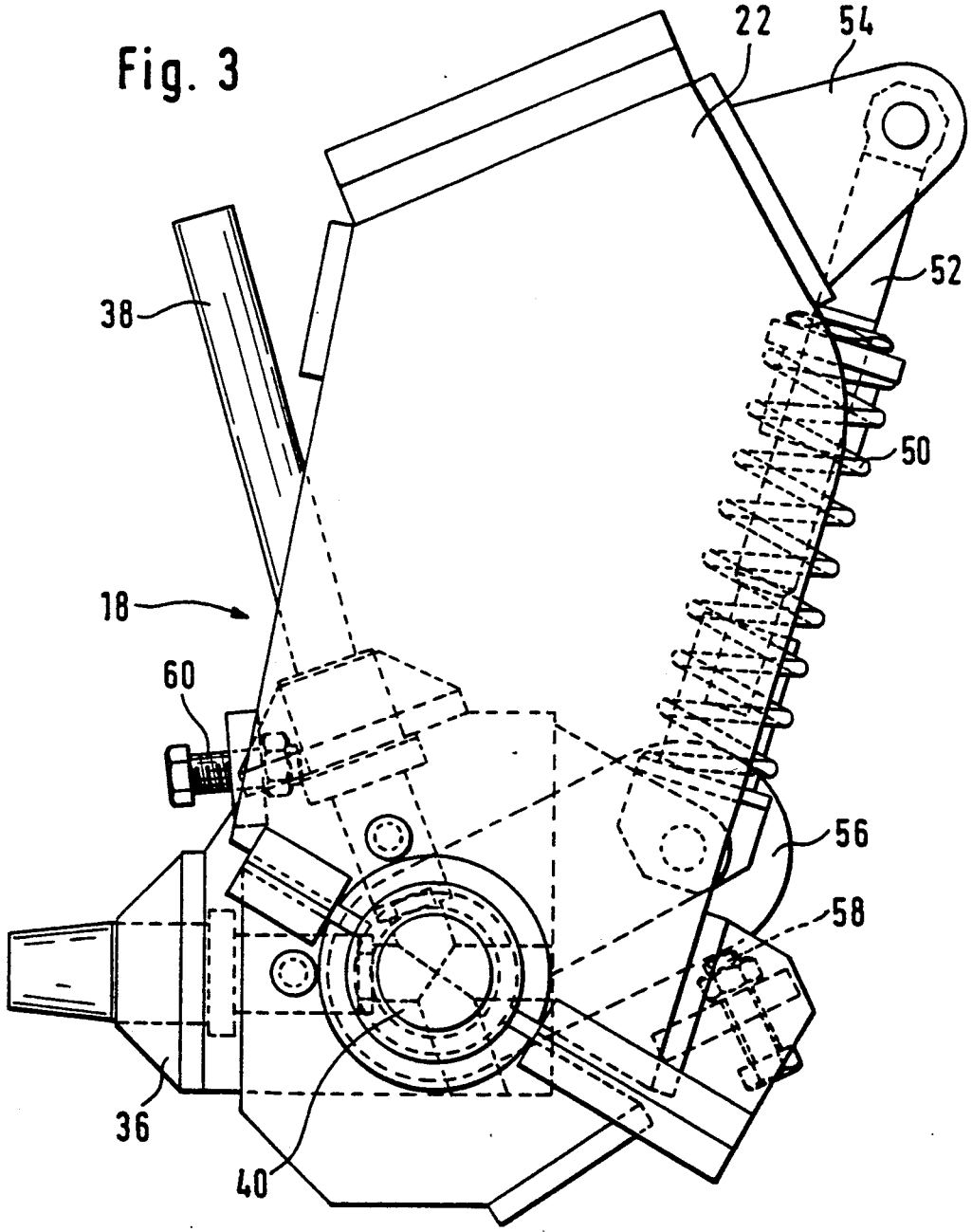
FIG. 3 shows an enlarged side view of the head of the control device, with the shut-off plug in the operative positions.

The stable positioning of the plug 36 in the operating position according to FIG. 3 and that of the rod 38 according to FIG. 4 are preferably obtained by means of a spring 50, the action of which is comparable to the spring 28 of FIGS. 1 and 2. This spring 50 is compressed around a positioning rod 52 articulated, on the one hand, on a flange 54 fixed to the support 22 and on a double lever arm 56 fixed to the plug 36 and to the rod 38. The pivoting range of the plug 36 and of the rod 38 under the action of the crank 46 is limited by two abutments 58 and 60 fastened to one of the plates 42, 44 of the support 22 and interacting with the double lever arm 56. The abutments 58 and 60 are preferably adjustable by means of adjusting screws in order to make it possible to adjust or modify the angular orientation of the plug 36 and of the rod 38, if required. In the position of FIG. 3, the spring 50 maintains the lever arm 56 bearing on the abutment 58, in order to ensure a stable orientation of the plug 36, while, as shown in FIG. 4, the spring 50 maintains the lever arm bearing on the abutment 60 in order to ensure a stable orientation o the rod 38. A pivoting from the position of FIG. 3 towards that of FIG. 4, and vice versa, under the action of the crank 46 can therefore be carried out in two phases, first counter to the action of the spring 56 until the dead center (axis) of the spring 50 is in alignment with the axis of rotation of the shaft 40, and thereafter under the action of the spring 50 to a stop against one of the two abutments 58, 60.

FIGS. 6 and 7 illustrate diagrammatically the maneuvering means for actuating the pivoting arm 24 and the crank 46. A carriage 60 is suspended from a framework 62 so as to be capable of sliding on the latter perpendicularly to the plane of the drawings under the action of a suitable motor (not shown). A first maneuvering arm 64 is articulated at one of its ends on the carriage 60 so as to be capable of pivoting in a vertical plane about a horizontal axis under the action of a hydraulic jack 66 provided between the carriage 60 and the arm 64. The end of the maneuvering arm 64 is configured in the form of a gripper 68 obtained by means of a jaw 70 capable of pivoting relative to the axis of the arm 64 under the action of a jack 72 mounted between the arm 64 and this jaw 70. In FIG. 6, the gripper 68 is shown in the closed position. The opening of the gripper 68 is achieved by the pivoting of the movable jaw 70 in the counterclockwise direction under the effect of the retraction of the jack 72.

A second maneuvering arm 74, partially masked by the jack 72 in FIG. 6, but clearly visible in FIG. 7, is likewise mounted pivotably on the carriage 60 so as to be capable of tilting in a vertical plane under the action of a jack 76 provided between the arm 74 and the carriage 60. The free end of this maneuvering arm 74 is designed in the form of a fork 78.

The functioning of the apparatus for an operation to empty a vessel 12 filled with slag coming from a metallurgical ladle or from a converter will now be described. This vessel 12 filled with liquid slag is brought by conventional means of transport to the slag discharge site next to the maneuvering installation of FIGS. 6 and 7, underneath which is located a slag treatment station of the type used for the granulation of blast-furnace slag, preferably an installation according to U.S. Pat. No. 4,289,519, the entire disclosure of which is incorporated herein by reference, disclosed of which is incorporated herein by reference, comprising a granulation head for solidifying the slag in jets of water, followed by a station for the filtration of the granulated slag. The vessel 12 is deposited there on a platform 80 (see FIG. 1) which is supported by load cells or weight sensors capable of continuously supplying information on the weight of the vessel and of its content.

During the transport of the vessel, the shut-off plug 36 is, of course, in the position of FIG. 1 and is maintained there sealingly under the effect of the pressure exerted by the spring 28. After the vessel 12 has been placed on the platform 80, the gripper 68 (see FIG. 6) is opened by the jack 72 and the carriage 60 is displaced perpendicularly to the plane of the drawings, the two maneuvering arms 64 and 74 being in the position according to FIG. 7. This displacement is intended to cause the bar 34 of the pivoting arm 24 to engage in the open gripper 68 which is immediately reclosed by the jack 72 for the correct positionings.

The next phase involves actuating the jack 66 in order to raise the maneuvering arm 64 from the position according to FIG. 6 towards that of FIG. 7, thereby causing the pivoting arm 24 to rotate counterclockwise about its pivot axis into the position illustrated in FIG. 2, this occurring first counter to and thereafter under the action of the spring 28. This movement also causes the crank 46 to engage in the cavity of the fork 78 of the maneuvering arm 74.

This maneuver opens the taphole 10, but does not necessarily allow the immediate flow of the slag, because it is likely that a layer of hardened or solidified slag has formed in the region of the taphole 10, thus obstructing its passage. If this is so, it is necessary to free the taphole 10 of its obstructing plug by means of the rod 38. For this purpose, the maneuvering arm 74 is raised by means of its jack 76, thereby, as a result of its action on the crank 46, causing the rotation of the shaft 40 in the counterclockwise direction and the pivoting of the plug 36—rod 38 assembly from the position of FIG. 3 towards the position of FIG. 4.

The maneuvering arm 64 is subsequently lowered once again into the position of FIG. 6 under the action of the jack 66, in order to rotate the pivoting arm 24 clockwise about its pivot axis and cause the rod 38 to penetrate through the taphole 10 so as to free the latter and initiate the flow of the liquid slag. The arm 64 is raised immediately as soon as the flow has started, in order to place the device in the position of FIG. 2 away from the stream of slag.

From that moment, the liquid slag can flow freely into a granulation device which, for example, can be of the type described in U.S. Pat. Nos. 4,204,855 and 4,289,519, the entire disclosures of which are incorporated herein by reference, and in which the slag is disintegrated and solidified under the action of powerful water jets. As provided in this patent, the quantity of granulating water can be adjusted as a function of the slag flow rate, this flow rate being known from the decrease in weight of the vessel. In addition to checking the weight of the vessel, it is also possible to carry out a visual monitoring of the flow by means of a television camera.

In the granulation device, it is also possible to influence the granulometry by the power of the jets of granulating water.

In comparison with current practice, the process provided by the present invention makes it possible to avoid the operation of crushing and pounding the slag and makes it possible to prevent the release of large quantities of dust. Furthermore, the vapour released as a result of the liquid granulation can easily be recovered if the process is carried out in a closed chamber having suction hoods. The capacity for influencing the granulometry of the solidified slag particles even makes it possible to consider the direct production of slag granules in a form which can be used as fertilizer.

When the vessel 12 is emptied of its contents, the maneuvering arm 74 is actuated by means of its jack 76 in order to pivot the shaft 40 in the clockwise direction, so that the shut-off plug 36 assumes its operative position according to FIG. 3. Subsequently, the maneuvering arm 64 is actuated in order to reclose the taphole 10 according to FIG. 1. The maneuvering device must then be cleared together with the carriage 60 in order to free the vessel 12 and remove it from the slag discharge site.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A process for the treatment of steel-mill slag contained in a liquid state in a vessel, including the steps of:

causing the slag to flow through an orifice near the bottom of the vessel;

determining the flow rate of the slag through said orifice by continuously checking the weight of the vessel;

directing at least one jet of water onto the stream of slag flowing from the vessel to granulate the slag; and adjusting the flow rate of said granulating water as a function of the flow rate of slag though said orifice.

2. The process of claim 1 wherein the step of causing the slag to flow through the orifice includes:

removing a plug from said orifice; and causing a rod to penetrate into said orifice to free said orifice of solidified slag obstructing said orifice.

3. Apparatus for the treatment of steel-mill slag, the apparatus including:

a vessel for containing the slag in a molten state;

orifice means near the bottom of said vessel;

plug means for closing off said orifice means;

maneuvering means for moving said plug means between a first position in which said plug means closes said orifice means and a second position in which said plug means is away from said orifice means; and penetration means operatively connected to said maneuvering means to enter said orifice means when said plug means is in its stored position to free said orifice means of hardened slag to permit flow of molten slag through said orifice means.

4. The apparatus of claim 3 including:

water supply means for delivering at least one jet of water onto the stream of slag flowing from said orifice to granulate the slag.

5. The apparatus of claim 3 wherein said first maneuvering means includes:

arm means pivotally mounted on the outer wall of said vessel; and spring means for maintaining said maneuvering means in either of said first or second positions.

6. The apparatus of claim 3, wherein:

said plug means and said penetration means are mounted on a shaft in angularly spaced apart relationship.

7. The apparatus of claim 6, including:

first stop abutment means for limiting the angular movement of said plug means;

second stop abutment means for limiting the angular movement of said penetrating means; and spring means for maintaining one of said plug means and said penetration means against its respective stop abutment, and the other of said plug means and said penetrating means in its operative position.

8. The apparatus of claim 7 including:

means for adjusting the position of each of said first and second stop abutments.

9. The apparatus of claim 3 including:

moveable carriage means to which said maneuvering means are connected.

10. The apparatus of claim 3 including:

first actuating means for moving said maneuvering means between said first and second positions thereof; and second actuating means for placing one of said plug means or said penetrating means in its operative position and the other of said plug means and said penetrating means out of its operative position.

11. The apparatus of claim 10 wherein:

said first actuating means includes means for operatively coupling with said maneuvering means; and said second actuating means includes means for operatively coupling with said plug means and said penetrating means.

12. The apparatus of claim 10 wherein:

said plug means and said penetrating means are mounted on a shaft in angularly spaced apart relationship;

said shaft is connected to crank means; and said second actuating means engages said crank means when said maneuvering means is in its second position.

13. The apparatus of claim 3 including:

weighing means for weighing said vessel;

water supply means for delivering at least one jet of water onto the stream of slag flowing from said orifice to granulate the slag; and means for adjusting the flow rate of said water as a function of the flow rate of slag through said orifice as determined from said weighing means.

14. The apparatus of claim 13 wherein:

said weighing means includes weight sensors on which said vessel is placed.

* * * * *